US008236233B2

(12) United States Patent
Matsumura et al.

(10) Patent No.: US 8,236,233 B2
(45) Date of Patent: Aug. 7, 2012

(54) TAPHOLE STRUCTURE OF MELTING FURNACE AND REPAIR METHOD THEREOF

(75) Inventors: Yasunari Matsumura, Tokyo (JP); Kohji Taoka, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 12/733,540

(22) PCT Filed: Sep. 3, 2008

(86) PCT No.: PCT/JP2008/065802

§ 371 (c)(1),
(2), (4) Date: Mar. 5, 2010

(87) PCT Pub. No.: WO2009/034886

PCT Pub. Date: Mar. 19, 2009

(65) Prior Publication Data

US 2010/0327498 A1 Dec. 30, 2010

(30) Foreign Application Priority Data

Sep. 10, 2007 (JP) ..... 2007-233631

(51) Int. Cl.
*C21B 7/12* (2006.01)

(52) U.S. Cl. ..... 266/45; 266/283

(58) Field of Classification Search ..... 266/283, 266/45

See application file for complete search history.

(56) References Cited

U.S. PATENT DOCUMENTS 3,343,827 A * 9/1967 Hansen ..... 266/236
4,097,033 A * 6/1978 Mailliet ..... 266/271
4,283,042 A * 8/1981 Kubo ..... 266/45
5,324,352 A * 6/1994 Hughes et al. ..... 106/284
7,237,596 B2 * 7/2007 Hanse et al. ..... 164/437

FOREIGN PATENT DOCUMENTS

| | | |
|---|---|---|
| GB | 1065259 | 4/1967 |
| JP | 60-77994 | 5/1985 |
| JP | 62-194748 | 12/1987 |
| JP | 4-69440 | 6/1992 |
| JP | 4-81950 | 7/1992 |
| JP | 7-260373 | 10/1995 |

(Continued)

OTHER PUBLICATIONS

Eugene C. Stafford, Modern Industrial Ceramics, 1980, The Bobs-Merrill Company, Inc., 1st Edition, p. 67, Fig. 16-1.*

FLS, Inc, Englsih language translation of: Sumiyoshi et al, "Converter tap hole sleeve brick", Jul. 1992, JPO, Japan Utility Model H04-081950, pp. 1-9.*

International Search Report dated Nov. 4, 2008 issued in corresponding PCT Application No. PCT/JP2008/065802.

European Search Report dated Sep. 1, 2010 in European Application No. EP08830068.6.

(Continued)

*Primary Examiner* — Scott Kastler
(74) *Attorney, Agent, or Firm* — Kenyon & Kenyon LLP

(57) ABSTRACT

A taphole structure of a melting furnace includes: a sleeve made of a fire-resistant brick, which is disposed inside a tapping hole provided in a furnace wall brick; and a ramming material which fills a gap between the sleeve and the tapping hole for fixing the sleeve. In addition, a repair method of the taphole which has expanded due to wear of a first ramming material during tapping, includes: forming a dismantled surface having a straight line shape by dismantling and removing a worn portion of the first ramming material in a straight line from an outer surface side toward an inner surface side of a furnace wall; and then filling a second ramming material into a gap between the dismantled surface having the straight line shape and a first sleeve for sealing.

3 Claims, 4 Drawing Sheets

FOREIGN PATENT DOCUMENTS

| | | | |
|---|---|---|---|
| JP | 2000-212616 | | 8/2000 |
| JP | 2004-218022 | | 8/2004 |
| JP | 2005-68446 | | 3/2005 |
| SU | 515786 | | 5/1976 |
| SU | 1033548 | | 8/1983 |
| WO | WO 00/49185 | * | 8/2000 |

OTHER PUBLICATIONS

Russian Decision on Grant dated Aug. 12, 2011, issued in corresponding Russian Patent Application No. 2010109064/02 and English translation thereof.

* cited by examiner

TAPHOLE STRUCTURE OF MELTING FURNACE AND REPAIR METHOD THEREOF

This application is a national stage application of International Application No. PCT/JP2008/065802, filed 3 Sep. 2008, which claims priority to Japanese Application No. 2007-233631, filed 10 Sep. 2007, which is incorporated by reference in its entirety.

TECHNICAL FIELD

The present invention relates to a taphole structure of a melting furnace and a repair method thereof capable of increasing the life of the taphole and reducing the repair time of the taphole.

BACKGROUND ART

A conventional example of a taphole structure of a melting furnace used for melting ores or the like, or a melting furnace such as a cupola is disclosed in Japanese Unexamined Utility Model Application, First Publication No. S62-194748. In the conventional example, a fire-resistant ramming material, which is a gap filling material, is filled into a hole provided in a furnace wall brick, and a tapping hole is opened to serve as a taphole. Also, a structure made by setting an iron pipe in the hole and burying the vicinity thereof with a fire-resistant ramming material, a structure made by preparing a taphole-attached precast member and mounting this in the hole of the furnace wall brick, and the like are known.

A taphole is a passage for flowing hot metal, which is subjected to melting in a melting furnace, out of the furnace. The vicinity of the taphole and an inner peripheral surface thereof always come into contact with high-temperature hot metal. Accordingly, there is a problem in that wear due to the hot metal and melting loss always occurs, thus the life of the taphole is very short. Particularly, in case of a taphole made of an iron pipe, wear is high. In addition, there is a problem in that when the diameter of the taphole expands due to the melting loss or the like in the taphole and the peripheral portion, there is a concern that gas in the melting furnace will be ejected from the furnace along with the hot metal.

Therefore, a replacement of the taphole is required every five or six days. In addition, the inner peripheral surface of the taphole needs to be repaired about every ten days, and frequent repair work is necessary.

For repair work on the taphole, generally, a hot pouring method of flowing alumina and silicon carbide ceramics into a worn point along with water, and a precast method of replacing the vicinity of the taphole with a tapping hole-attached precast member which is individually molded are employed.

Particularly, the precast method has problems in that as a dismantled part becomes larger, a longer period of repair is needed, resulting in a further increase in cost. Accordingly, the hot pouring method without the above-mentioned problems has been generally used.

However, in the hot pouring method, there is a problem in that it is difficult to perform a complete repair on the vicinity of the inner peripheral surface of the furnace, and durability is low even after the repair, so that frequent repairs are needed.

FIGS. 5A to 5D schematically show a repair method using the hot pouring method. FIG. 5A shows an initial state, FIG. 5B shows initial damage, FIG. 5C shows a state after a first repair, and FIG. 5D shows a state after a second repair. In FIGS. 5A to 5D, reference numeral 21 denotes a furnace wall brick, reference numeral 21*a* denotes a tapping hole provided in the furnace wall brick 21, reference numeral 22 denotes a pipe made of iron, which is disposed inside the tapping hole 21*a*, and reference numeral 23 denotes a ramming material filled into a gap between the pipe and the tapping hole 21*a*.

In the hot pouring method, as shown in FIG. 5B, in a case where damage of the ramming material 23 occurs, a metal frame 24 for hot pouring is set outside of the furnace as shown in FIG. 5C, and a pouring material 25 made of alumina and silicon carbide ceramics is injected for repair. However, since gas pressure is applied from inside the furnace and scattered residuals remain after dismantling, the pouring material 25 cannot reach the inner side, and, as a result, a space 26 is formed. Therefore, a complete restoration cannot be achieved. Furthermore, as shown in FIG. 5D, although the space 26 gradually increases, this cannot be prevented. As such, in the repair method using the hot pouring method, there is low durability and frequent repairing work is necessary. Therefore, the development of a new taphole structure and a repair method thereof capable of increasing the life of the taphole is required.

DISCLOSURE OF THE INVENTION

Problem that the Invention is to Solve

The present invention has an object of providing a taphole structure and a repair method thereof capable of increasing the life of the taphole, reducing repair time of the taphole, and restoring the inside of the furnace to solve the above-mentioned problems.

Means for Solving the Problem

The present invention provides the following in order to solve the above-mentioned problems and achieve the object.

(1) A taphole structure of a melting furnace according to the present invention includes: a sleeve made of a fire-resistant brick, which is disposed inside a tapping hole provided in a furnace wall brick; and a ramming material which fills a gap between the sleeve and the tapping hole for fixing the sleeve.

(2) The sleeve may be made of an alumina graphite brick.

(3) The sleeve may be a cylindrical member.

(4) The sleeve may be a cylindrical member of which an end portion on an inward side of the furnace is obliquely cut.

(5) The sleeve may have a half cylindrical shape formed by cutting a lower surface of a cylindrical member.

(6) A repair method of a taphole, which has expanded due to wear of a first ramming material during tapping, according to the present invention includes: forming a dismantled surface having a straight line shape by dismantling and removing a worn portion of the first ramming material in a straight line from an outer surface side toward an inner surface side of a furnace wall; and then filling a second ramming material into a gap between the dismantled surface having the straight line shape and a first sleeve for sealing.

(7) A second sleeve made of a fire-resistant brick, which has a half cylindrical shape formed by cutting a lower surface of a cylindrical member, may be disposed instead of the worn and damaged first sleeve when the dismantling is performed.

Advantage of the Invention

With the taphole structure according to (1) above, in which the sleeve made of the fire-resistant brick is disposed inside the tapping hole provided in the furnace wall brick, and the ramming material is filled into the gap between the sleeve and the tapping hole for fixing the sleeve, since the sleeve made of the fire-resistant brick is used, it is possible to significantly enhance the durability as compared with an existing iron pipe.

With the taphole structure according to (2) above, since the sleeve made of the fire-resistant brick is made of the alumina graphite brick, it has particularly excellent durability, thereby suppressing wear and melting loss.

With the taphole structure according to (3) to (5) above, the sleeve made of the fire-resistant brick is either the cylindrical member, the cylindrical member of which the end portion on the inward side of the furnace is obliquely cut, or the half cylindrical member formed by cutting the lower surface of the cylindrical member, so it can be easily mounted in the taphole.

With the repair method of the taphole according to (6) above, the dismantled surface having the straight line shape is formed by dismantling and removing the worn portion of the first ramming material in a straight line from the outer surface side toward the inner surface side of the furnace wall, and then the second ramming material is filled into the gap between the dismantled surface having the straight line shape and the first sleeve for sealing. Therefore, it is possible to reduce the repair time and restore the inner side of the furnace.

With the repair method of the taphole according to (7) above, the second sleeve made of the fire-resistant brick, which has the half cylindrical shape formed by cutting the lower surface of the cylindrical member, is disposed instead of the worn and damaged first sleeve when the dismantling is performed so that the sleeve can be easily mounted.

DESCRIPTION OF REFERENCE NUMERALS AND SIGNS

1 FURNACE WALL BRICK
1*a* TAPPING HOLE
2 SLEEVE
2*a* INCLINED PORTION
2*b* HORIZONTAL SURFACE
3 RAMMING MATERIAL (FIRST RAMMING MATERIAL)
4 DISMANTLED SURFACE HAVING STRAIGHT LINE SURFACE
5 NEW RAMMING MATERIAL (SECOND RAMMING MATERIAL)

BEST MODE FOR CARRYING OUT THE INVENTION

Hereinafter, exemplary embodiments of the present invention will be described with reference to the accompanying drawings.

Figure 1A:
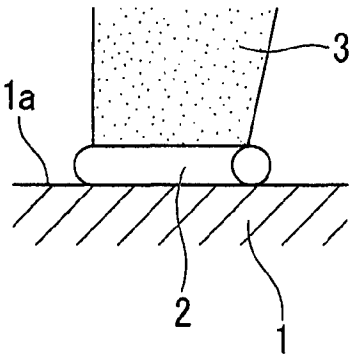
FIG. 1A is a cross-sectional view schematically showing a repair method according to an embodiment of the present invention and an initial state.
Figure 1B:
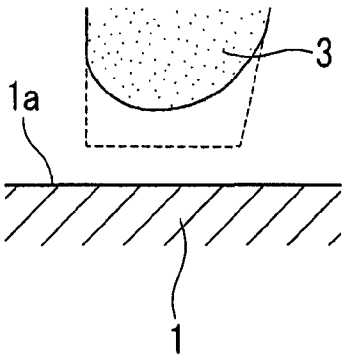
FIG. 1B is a cross-sectional view schematically showing the repair method and initial damage.
Figure 1C:
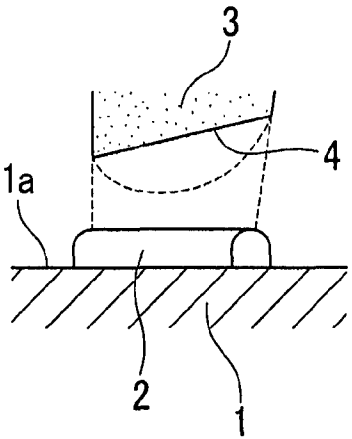
FIG. 1C is a cross-sectional view schematically showing the repair method and a state of dismantling and removing the ramming material.
Figure 1D:
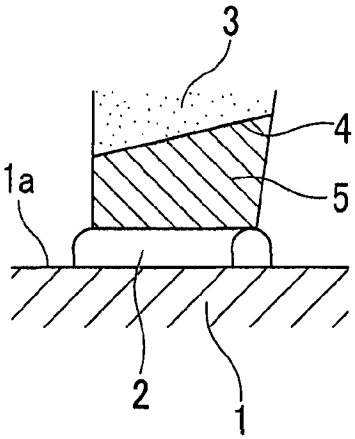
FIG. 1D is a cross-sectional view schematically showing the repair method and a state of filling a new ramming material.

FIGS. 1A to 1D schematically show a repair method according to this embodiment. FIG. 1A is a cross-sectional view schematically showing the repair method according to the embodiment and an initial state. FIG. 1B shows initial damage. FIG. 1C shows a state of dismantling and removing the ramming material. FIG. 1D shows a state of filling a new ramming material.

In FIGS. 1A to 1D, reference numeral 1 denotes a furnace wall brick, reference numeral 1*a* denotes a tapping hole provided in the furnace wall brick 1, reference numeral 2 denotes a sleeve made of a fire-resistant brick, which is disposed inside the tapping hole 1*a*, and reference numeral 3 denotes a ramming material filled into a gap between a pipe and the tapping hole 1*a*.

A taphole of the present invention includes a structure in which, as shown in FIG. 1A, the sleeve 2 made of the fire-resistant brick is disposed inside the tapping hole 1*a* provided in the furnace wall brick 1 and the ramming material 3 is filled into the gap between the sleeve 2 and the tapping hole 1*a*.

As described above, by using the sleeve 2 made of the fire-resistant brick, it is possible to significantly enhance durability as compared with an existing iron pipe.

It is preferable that the sleeve 2 made of the fire-resistant brick be particularly made of an alumina graphite brick (called an AG brick). The alumina graphite brick is made of a ceramics raw material having 68% of $Al_2O_3$, 3% of SiC, and 28% of C in weight % and has excellent fire resistance and wear resistance. Accordingly, it exhibits durability against hot metal, thereby minimizing wear and melting loss.

In addition, the ramming material 3 which is a gap filling material is made of a ceramics raw material having, for example, 65% of $Al_2O_3$, 5% of $SiO_2$, 24% of SiC, and 2% of C in weight %. Furthermore, the sleeve 2 made of the fire-resistant brick and the ramming material 3 have thermal expansion coefficients close to each other and thus have good compatibility. Therefore, there is no situation in which a gap occurs on a joining surface, and good workability can be achieved.

Figure 2:
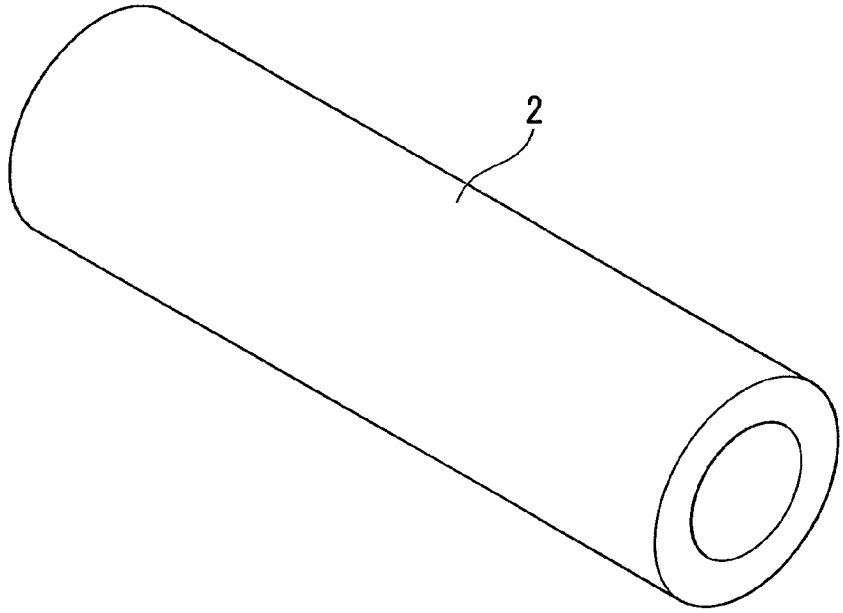
FIG. 2 is a perspective view showing a sleeve according to the embodiment.
Figure 3:
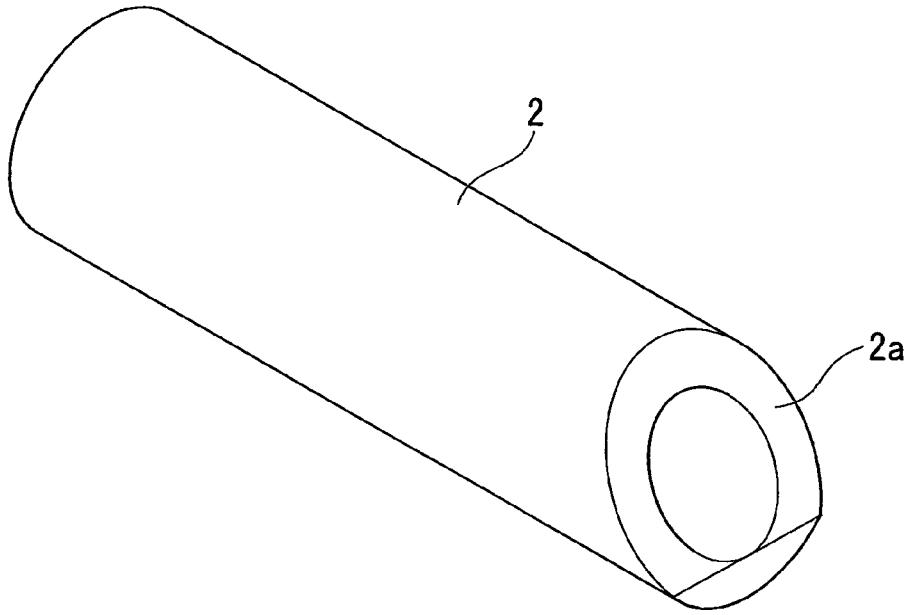
FIG. 3 is a perspective view showing a modified example of the sleeve.
Figure 4:
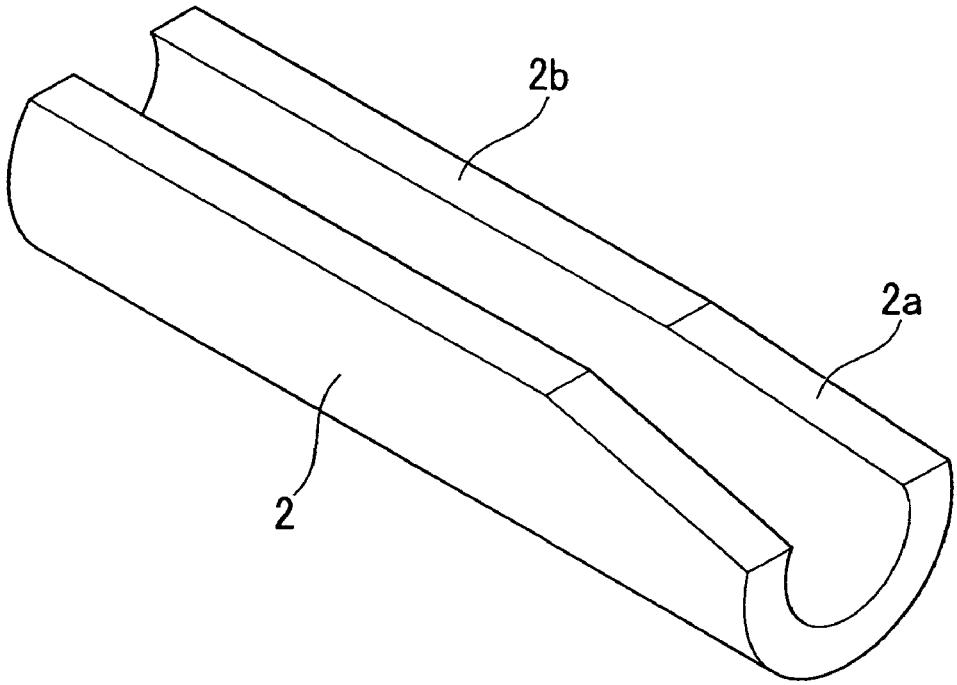
FIG. 4 is a perspective view showing another modified example of the sleeve.
Figure 5A:
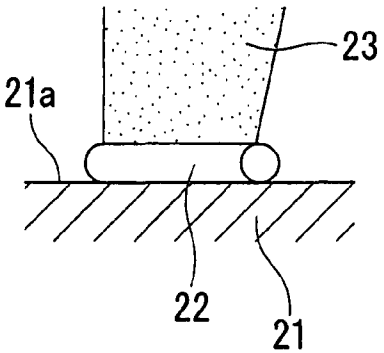
FIG. 5A is a cross-sectional view schematically showing a repair method using a hot pouring method and an initial state.
Figure 5B:
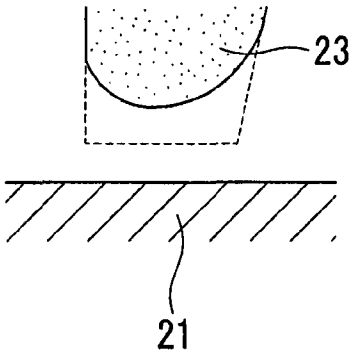
FIG. 5B is a cross-sectional view schematically showing the repair method and initial damage.
Figure 5C:
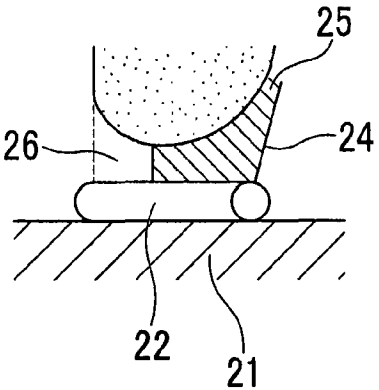
FIG. 5C is a cross-sectional view schematically showing the repair method and a state after a first repair.
Figure 5D:
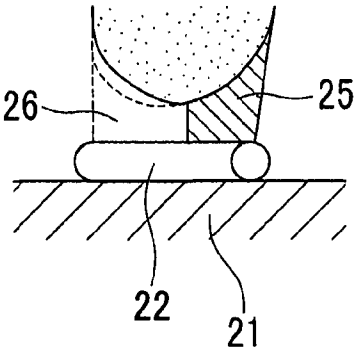
FIG. 5D is a cross-sectional view schematically showing the repair method and a state after a second repair.

As a shape of the sleeve 2 made of the fire-resistant brick, a cylindrical member as shown in FIG. 2 may be employed. In addition, a cylindrical member having an inclined portion 2*a* formed by obliquely cutting an end portion on the inward side of the furnace as shown in FIG. 3 may be employed. Or an open-tube-shaped half cylindrical member having a horizontal surface 2*b* formed by cutting a lower surface of a cylindrical member and an inclined portion 2*a* formed by obliquely cutting the end portion on the inward side of the furnace as shown in FIG. 4 may be employed. As shown in FIGS. 3 and 4, in the structure having the inclined portion 2*a* formed by obliquely cutting the end portion on the inward side of the furnace, a front end side thereof is sharpened, so that it can be easily inserted when disposed inside the tapping hole 1*a*, which is preferable.

Next, an embodiment of a repair method of the taphole of the present invention will be described.

FIG. 1B is a view showing an initial damage state. With regard to the damage of the taphole, in addition to the sleeve 2, the ramming material 3 is significantly worn and has significant melting loss. In terms of the improvement of the durability of the sleeve 2, as described above, it was found that the improvement is exhibited to some extent by using the sleeve made of the fire-resistant brick. However, the wear and melting loss of the ramming material 3 can be repaired by using only the existing heat pouring and the precast methods, and, thus, a repair method satisfying all the factors such as durability, repair period, and costs did not exist. Furthermore, there is a concern that the wear and melting loss of the ramming material 3 causes the gas inside the melting furnace to be ejected from the furnace along with the hot metal. Therefore, the development of a new ramming material repair method was required.

Therefore, according to the embodiment, after dismantling and removing a worn portion of the ramming material 3 in a straight line from an outer surface side toward an inner surface side of the furnace wall as shown in FIG. 1C, a new ramming material 5 is filled into a gap between a dismantled surface 4 with the straight line shape and the sleeve 2 for sealing as shown in FIG. 1D. In addition, the above-mentioned dismantling performed in a straight line from the outer surface side toward the inner surface side of the furnace wall leaves a simple shape, so that a general dismantling heavy machine can be used, thereby achieving a reduction in work period. Furthermore, as shown in FIGS. 1C and 1D, the dismantled surface 4 is formed so that the gap between it and the tapping hole 1*a* is widened from an inside toward an outside of the furnace wall (in other words, is narrowed from the outside toward the inside of the furnace wall). As the gap is formed as described above, the ramming material 5 can be easily filled into the gap to an inward portion thereof.

With such a configuration described above, the ramming material 5 can be filled into the entire gap from the outside to the inside of the furnace wall, thereby restoring the initial state. Accordingly, there is no problem that restoration of the inside of the furnace wall cannot be implemented as in the hot pouring method, but rather a complete restoration is possible. Moreover, unlike the precast method, the repair can be performed in a short work period and at a low cost.

In addition, during the dismantling, when a new sleeve 2 made of a fire-resistant brick, which has a half cylindrical shape formed by cutting a lower surface of a cylindrical member as shown in FIG. 4, is disposed instead of the worn and damaged old sleeve, although waste such as rubble remain in the space after the dismantling, the sleeve 2 is guided by the inclined portion 2*a* on the front end and properly inserted, so that the sleeve 2 can be easily mounted.

As described above, in the taphole structure of the melting furnace according to the embodiment, the sleeve 2 made of the fire-resistant brick is disposed inside the tapping hole 1*a* provided in the furnace wall brick 1, and the ramming material 5 is filled into the gap between the sleeve 2 and the tapping hole 1*a* for fixing the sleeve 2, so that it is possible to significantly enhance the durability as compared with a case of employing an existing iron pipe.

In addition, in the repair method of the taphole according to this embodiment, after dismantling and removing the worn portion of the ramming material 3 in a straight line from the outer surface side toward the inner surface side of the furnace wall, the new ramming material 5 is filled into the gap between the dismantled surface 4 having the straight line shape and the sleeve 2 for sealing, thereby reducing the repair time and implementing a restoration of the inside of the furnace.

In addition, with the taphole structure described above, even after fourteen days, damage such as melting loss was not observed in the vicinity of the sleeve 2 and the taphole, and the taphole structure still had sufficient strength. Therefore, it could be seen that the life thereof is significantly increased as compared with the conventional structure which requires replacement in less than one week. Furthermore, it could be seen that a life of 90 or more days could be achieved in terms of the damage of the inner periphery of the furnace wall. Moreover, a repair time of less than 24 hours could be achieved.

INDUSTRIAL APPLICABILITY

As apparently shown by the above description, the present invention provide the taphole structure of the melting furnace and the repair method thereof capable of achieving an extension of the life of the taphole, reducing the repair time of the taphole, and restoring the inside of the furnace, so that it greatly contributes to the development of the industry.

The invention claimed is:

1. A taphole structure of a melting furnace, comprising:

a sleeve made of a fire-resistant brick, which is disposed inside a tapping hole provided in a furnace wall brick; and a ramming material which fills a gap between the sleeve and the tapping hole for fixing the sleeve, wherein the sleeve has a half cylindrical shape having a horizontal surface formed by cutting a lower surface of a cylindrical member, and wherein an end portion of the horizontal surface of the sleeve at an inward side of the furnace is obliquely cut.

2. The taphole structure according to claim 1, wherein the sleeve is made of an alumina graphite brick.

3. A repair method of a taphole which has expanded due to wear of a first ramming material during tapping, the repair method comprising:

forming a dismantled surface having a straight line shape by dismantling and removing a worn portion of the first ramming material in a straight line from an outer surface side toward an inner surface side of a furnace wall so that a gap formed between the dismantled surface and an old sleeve widens going from the inside surface side toward the outer surface side of the furnace wall;

replacing the old sleeve with a new sleeve which has a half cylindrical shape having a horizontal surface formed by cutting a lower surface of a cylindrical member, wherein an end portion of the horizontal surface at an inward side of the furnace is obliquely cut, and which is made of a fire-resistant brick; and filling a second ramming material into the gap between the dismantled surface having the straight line shape and a first sleeve for sealing.

* * * * *